United States Patent [19]

Walter

[11] Patent Number: 4,642,962

[45] Date of Patent: Feb. 17, 1987

[54] DEVICE FOR SEALED ATTACHMENT OF FLEXIBLE COVER STRIPS FOR SINGLE- OR DOUBLE-CURVE ROOF SURFACES OF BUILDINGS

[75] Inventor: Josef Walter, Würzburg, Fed. Rep. of Germany

[73] Assignee: Mero-Raumstruktur GmbH & Co., Wurzburg, Fed. Rep. of Germany

[21] Appl. No.: 754,128

[22] Filed: Jul. 12, 1985

[30] Foreign Application Priority Data

Jul. 14, 1984 [DE] Fed. Rep. of Germany ..... 34260277

[51] Int. Cl.[4] ..... E04D 1/36; E04B 1/32

[52] U.S. Cl. ..... 52/460; 52/63; 52/82

[58] Field of Search ..... 52/82, 459–469, 52/63, 273; 135/102

[56] References Cited

U.S. PATENT DOCUMENTS 3,398,496 8/1968 Mischke ..... 52/463
3,550,335 12/1970 Huffman ..... 52/82
3,999,336 12/1976 Bance ..... 52/463

FOREIGN PATENT DOCUMENTS 209483 7/1957 Australia ..... 52/463
1115431 10/1961 Fed. Rep. of Germany ..... 52/465
307242 8/1955 Switzerland ..... 52/463

*Primary Examiner*—J. Karl Bell
*Attorney, Agent, or Firm*—Quaintance, Murphy & Presta

[57] ABSTRACT

A device for sealed attachment of substantially flat-surfaced cover strips, especially of sheet metal, for single- or double-curve roof surfaces of buildings, with top and bottom clamping members, which can be braced for the side attachment of adjacent cover strips by opposing bolts and which can be attached to a supporting frame. The clamping members have flat clamping surfaces to contact the substantially flat-surfaced cover strips and have clamping bolts that extend through openings on the lengthwise edge of at least one of any two adjacent cover strips. Cover rails are attached to the top clamping members and pass therethrough and are clamped by means of crosspieces which feather out to the side, which on their lengthwise edge carry sealing strips pressed against the outsides of adjacent cover strips. The bottom clamping members each have a crosspiece extending downwardly and having side retaining flanges, by which they are held in a lengthwise slit in profile rods, which run parallel to the cover strips and are attached to the supporting frame.

8 Claims, 2 Drawing Figures

DEVICE FOR SEALED ATTACHMENT OF FLEXIBLE COVER STRIPS FOR SINGLE- OR DOUBLE-CURVE ROOF SURFACES OF BUILDINGS

BACKGROUND OF THE INVENTION

The invention relates to a device for sealed attachment of flexible cover strips, especially of sheet metal, for single- or double-curve roof surfaces of buildings, with top and bottom clamping members, which can be braced for the attachment of adjacent cover strips along their respective sides by opposing bolts, and can be attached to a supporting frame.

Until the present time, strips of sheet metal have been used for covering single (cylindrical) or double (cupola-shaped) curved roof surfaces of buildings, which strips are bent or angled downward a number of times at their lengthwise edges and are fastened to a supporting frame by top and bottom clamping members (See U.S. Pat. No. 4,271,651). This construction is subject to problems in that creases arise in the multiple folds of the bent down lengthwise edges of the strips of sheet metal used in curved roof surfaces and corresponding material stresses thus occur. Finally, the multiple folding of the lengthwise edges of the sheet metal cover strips makes their production more costly, and the transportation of such cover strips is relatively complicated.

SUMMARY OF THE INVENTION

An object of the present invention is an attachment device for flexible cover strips, which are essentially flat-surfaced at least in cross section, so that they can be produced at low cost, and are simple to transport and to mount on curved roof surfaces, without the material stresses arising which have been customary until this time. At the same time, the attachment device of the present invention includes an effective security mechanism to prevent detachment of the cover strips by wind or other forces.

According to the present invention, this is accomplished as follows:

(a) The clamping members have flat clamping surfaces to clamp the cover strips which are essentially flat-surfaced in cross section;

(b) The clamping bolts of the clamping members extend through openings at the lengthwise edge edge of at least one of any two adjacent cover strips;

(c) Cover rails are attached to the top clamping members by means of crosspieces which extend out to the sides and carry sealing strips on their lengthwise edges, pressed against the outside of adjacent cover strips; and (d) The bottom clamping members have a projection or crosspiece extending downwardly with side retaining flanges, with which they are held longitudinally movably in lengthwise slits in profile rods, which run parallel to the cover strips and are fastened on the supporting frame. Thus, in addition to the advantages of low cost and being simply transportable, as well as being stress-free in mounting, the cover strips can be used for covering single- or double-curve roof surfaces, and the clamping bolts of the clamping members, which extend through openings on the lengthwise edge of at least one of any two adjacent cover strips, form an improved "suction prevention."

This "suction prevention" can be still further increased in that openings are provided on the lengthwise edges of both adjacent cover strips for the passage of additional clamping bolts of the clamping members The cover strips are specifically sealed on the outside by means of cover rails passing therethrough, which carry sealing strips on their lengthwise edges, which are pressed against the outsides of adjacent cover strips when the cover rails are attached or snapped onto the top clamping members in a simple manner. The construction of the present invention ensures that the cover strips, which can have a length of up to 10 m and longer, can be moved axially together with their clamping members, relative to the profile rods, under the influence of temperature deviations, and the profile rods in turn are fastened tightly to the supporting frame of the building. The temperature-controlled lengthwise movement of the cover strips relative to the supporting frame is thus ensured. The attachment arrangement according to the invention is suitable for flexible cover strips of many different, and even transparent, metals and plastics. However, cover strips of sheet metal are preferred (except for sealing strips).

If the clamping members are formed of fillet members, a low type of construction or low cover rail height is attained, and the rails are thus inconspicuous.

Other advantages resides in the further improvement of the clamping connection between the cover rails and the top clamping members.

The present invention also provides an aerial structure and structural simplification in which the bottom clamping fillet members can be configured as extruded profiles, which saves material.

The features of the present invention provides a technical production advantage because it is irrelevant to the required flexing or curving of the profile rods whether the narrow side is on the outside or the inside.

BRIEF DESCRIPTION OF THE DRAWINGS

The invention is to be explained in more detail relative to the drawings which show one exemplary embodiment.

DESCRIPTION OF THE PREFERRED EMBODIMENT

Figure 1:
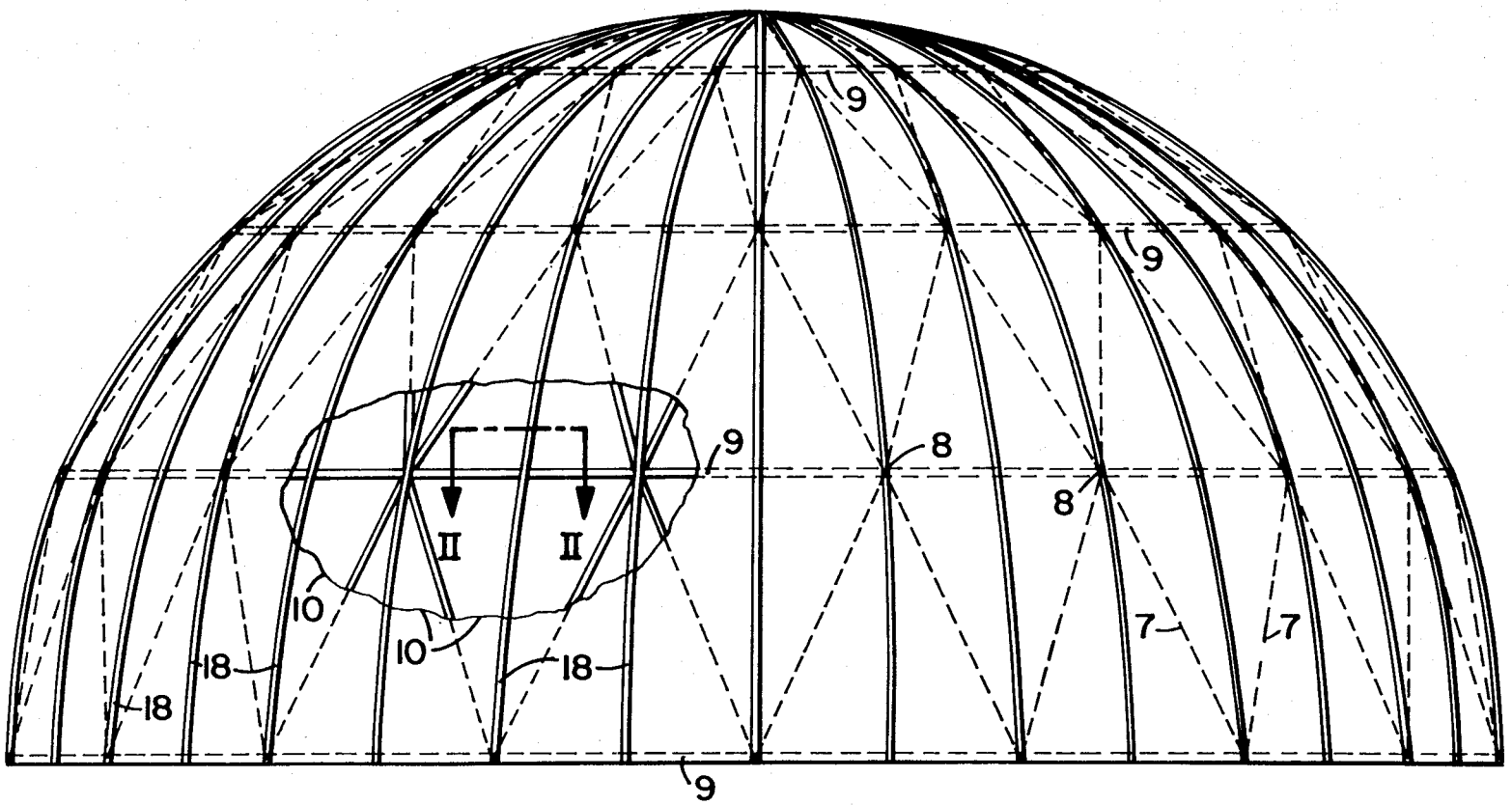
FIG. 1 is a side elevational view of part of a cupola-shaped roof, which is to be provide with cover strips, which are to be attached according to the present invention.

The cupola-shaped roof of a building which is shown partially in FIG. 1 has a supporting frame of a one-sheet space framework, consisting of rods 7 and joints 8, to which are fastened additional roof beams 9, which extend annularly at different levels and are in the form of tubes.

The roof covering is formed of a plurality of flexible cover strips 10, which are essentially flat-surfaced as seen in cross section and of which a few are shown partially as an exemplary embodiment in FIG. 1. The slight curvature of cover strips 10 shown in FIG. 2 in transverse section embodies the curve of the cupola. These cover strips 10 can be relatively long (up to and longer than 10 m), their length being finally dependent upon their transportability. Smooth fillet-like clamping members 11 and 12 are provided for connection of two adjacent cover strips along their lengthwise top and bottom edges, and they can be, e.g., 2 m long. Clamping members 11,12 are provided with flat clamping surfaces 11*a* and 12*a*, which are pressed against cover strips 10 by clamping bolts 13. Clamping bolts 13 extend through openings 14 at the lengthwise edge in turn of one of the two adjacent cover strips 10 and are screwed into a lengthwise slit which is serrated on both side walls in bottom clamping member 12. Clamping bolts 13 can be screwed into bottom clamping member 12 at the desired lengthwise positions by virtue of the arrangement of this serrated lengthwise slit 23.

Figure 2:
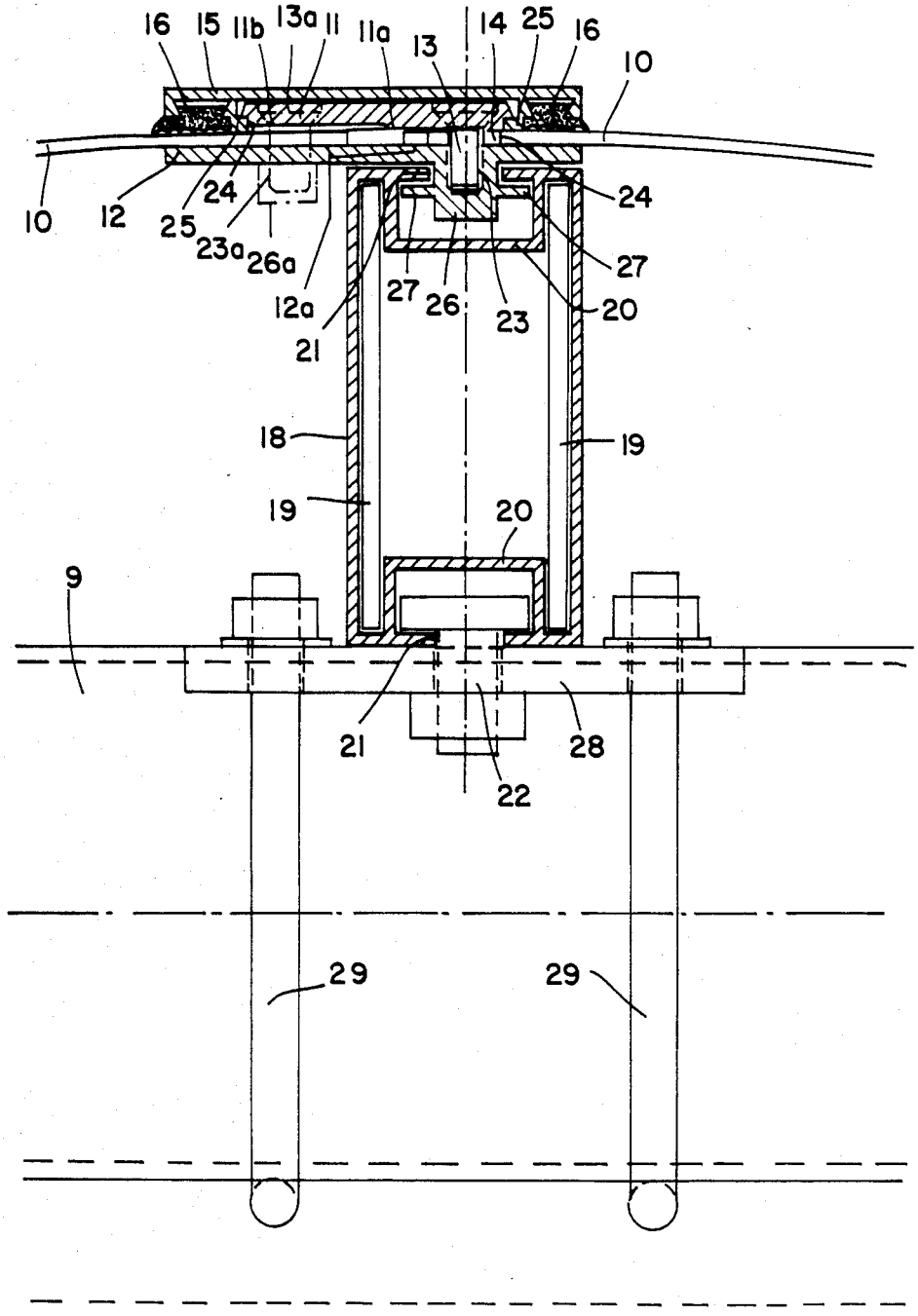
FIG. 2 is an enlarged cross sectional view taken substantially along line II—II of FIG. 1, which shows the attachment arrangement for the cover strips.

Cover rails 15 are clamped or snapped onto top clamping members 11 and pass therethrough, and their length can correspond to that of cover strips 10. The lengthwise edges of top clamping members 11 are undercut at 24 and tip-stretched onto cover rails 15, and by their feathering out engage with corresponding projections or crosspieces 25 which fit into the undercut lengthwise edges of top clamping members 11, as shown in FIG. 2. Cover rails 15 carry sealing strips 16 on their lengthwise edges, which are pressed against the outsides of adjacent cover strips 10 when cover rails 15 are snapped on.

Lengthwise slit 23 which is intended to receive clamping bolts 13 extends into a crosspiece 26 which projects downwardly and is tip-stretched onto bottom clamping member 12. Crosspiece 26 is provided with retaining flanges 27 on both sides. Bottom clamping members 12 are inserted with the crosspiece 26 into the front of lengthwise slip 21 of profile rod 18 of rectangular section, so that retaining flanges 27 are then inside the profile rod 18. Clamping members 11 and 12 connected by bolts 13 can be moved so that cover strips 10 clamped between these parts can be moved in an axial direction relative to profile rods 18, in order to compensate for heat expansion. Profile rods 18 run parallel to cover strips 10 and can be of the same length.

With high cupola shapes, profile rods 18 are connected by shims 19 at the front, which can be fastened to one of the two profile rods 18 which are to be connected, and engage loosely in the adjacent profile rod 18. Profile rods 18 in the exemplary embodiment are provided with lengthwise slits 21 on both narrow sides, which slits are each covered on the inside by ridges 20 of the same slight cross section which are formed thereon. Bolts with heads 22 inserted on the front side extend through bottom lengthwise slit 21 of profile rod 18 by means of which the plates 28 are further connected with annular roof beams 9 of the supporting frame by U-shaped brackets 29.

Cover strips 10 can be of sheet metal, e.g. aluminum, and in the clamping members 11 and 12 may also preferably be of the same material. This is also true for cover rails 15. Cover strips 10 and their clamping members 11,12, as well as cover rails 15, however, can also be of a suitable plastic of a metal-plastic combination.

In broken lines, FIG. 2 shows a second crosspiece 26*a* at the bottom, tip-stretched thereon and projecting downwardly, running parallel to crosspiece 26, and including a lengthwise slit 23*a* which is serrated on the side walls intended to hold more clamping bolts 13*a* of clamping members 11, 12. In this case, openings are provided for clamping bolts 13, 13*a* on the lengthwise edges of both adjacent cover strips 10, attaining a still more effective protection of the cover strips relative to wind forces. At 11*b*, FIG. 2 shows the slightly offset clamping surface, which allows temperature-controlled transverse movement of cover strip 10.

What is claimed is:

1. Device for sealed attachment of substantially flat-surfaced flexible cover strips, especially of sheet metal, for single- or double-curve roof surfaces of buildings, with top and bottom clamping members, which can be braced for the side attachment of adjacent cover strips by opposing bolts and which can be attached to a supporting frame, characterized in that:

(a) the clamping members (11,12) have flat clamping surfaces (11*a*,12*a*) to contact the substantially flat-surfaced cover strips (10), (b) the clamping members (11,12) have clamping bolts (13) that extend through openings (14) on the lengthwise edge of at least one of any two adjacent cover strips (10), (c) cover rails (15) are attached to the top clamping members (11) and pass therethrough and are clamped by means of crosspieces (25) which feather out to the side, which on their lengthwise edges carry sealing strips (16) pressed against the outsides of adjacent cover strips (10), (d) the bottom clamping members (12) each have a crosspiece (26) extending downwardly and having side retaining flanges (27), by which they are held in the lengthwise slit (21) in profile rods (18), which run parallel to the cover strips (10) and are attached to the supporting frame (7–9), and (e) threaded openings (23) for the clamping bolts (13) of the clamping members (11,12) are provided in the crosspiece (26) which extends downwardly from the bottom clamping member (12).

2. Device as in claim 1, characterized in that the clamping members (11,12) are smooth fillet members.

3. Device as in claim 1, characterized in that the edges of the top clamping member (11) are undercut at (24) and the crosspieces (25) which feather out to side from cover rails (15), have a projection for fitted engagement in the associated undercut lengthwise edge of the clamping member (11).

4. Device as in claim 1, characterized in that the openings (23) for the clamping bolts (13) of the clamping members (11,12) extend in the crosspiece (26) which extends downward from the bottom clamping member (12).

5. Device as in claim 1, characterized in that the bottom clamping member (12) has a second crosspiece (26*a*) extending downwardly with openings (23*a*) for additional clamping bolts (13*a*), which runs offset to the side and substantially parallel to the first crosspiece (26) projecting downward with the side retaining flanges (27).

6. Device as in claim 1, characterized in that the lengthwise slit (21) in profile rod (18) is provided with a rectangular transverse section on the narrow side and is covered on the inside by a ridge (20) formed thereon, which receives the part of the crosspiece (26) which extends downwardly, which supports the side retaining flange (27).

7. Device as in claim 6, characterized in that the profile rods (18) are provided with rectangular transverse section on both narrow sides in diametric opposition with lengthwise slits (21) and ridges (20) formed thereon and with head bolts (22) that are arranged in one of the lengthwise slits (21) for attachment of the profile rods (18) to the supporting frame (7–9).

8. Device as in claim 1, characterized in that the clamping surface (11*a*) of the top clamping member (11) is slightly offset (11*b*) from the lengthwise edge of one cover strip (10), in order to allow a temperature-controlled transverse movement of the cover strips (10).

* * * * *